US005085262A

United States Patent [19]

Tutikawa

[11] Patent Number: 5,085,262

[45] Date of Patent: Feb. 4, 1992

[54] DEVICE FOR SUPPORTING FOLDING DOORS

[75] Inventor: Yoshiji Tutikawa, Osaka, Japan

[73] Assignee: Daiyusu Kinzoku Co., Ltd., Osaka, Japan

[21] Appl. No.: 572,352

[22] Filed: Aug. 27, 1990

Related U.S. Application Data

[63] Continuation of Ser. No. 308,619, Feb. 10, 1989, abandoned.

[51] Int. Cl.[5] ..... E05D 15/26

[52] U.S. Cl. ..... 160/199; 160/206

[58] Field of Search ..... 160/199, 196.1, 201, 160/118, 206, 213, 186, 187; 16/87.4 R, 94 D, 95 D, 96 D

[56] References Cited

U.S. PATENT DOCUMENTS

| | | | |
|---|---|---|---|
| 1,384,763 | 7/1921 | Jordan | 160/199 |
| 1,426,170 | 8/1922 | Frantz | 160/196.1 X |
| 1,444,349 | 2/1923 | Leeds | 160/196.1 X |
| 1,545,565 | 7/1925 | Lang | 160/199 |
| 2,075,716 | 3/1937 | Harrison | 160/206 |
| 2,959,220 | 11/1960 | Latham | 160/199 |
| 3,003,551 | 10/1961 | Ferris | 160/196.1 |
| 3,160,201 | 12/1964 | Johnson | 160/187 X |
| 3,162,890 | 12/1964 | Brydolf et al. | 160/206 X |
| 3,170,506 | 2/1965 | Johnson | 160/118 X |
| 3,277,951 | 10/1966 | Levicke | 160/206 X |
| 3,335,784 | 8/1967 | Risk et al. | 160/199 |
| 3,554,267 | 1/1971 | Brinker | 160/118 |
| 3,720,255 | 3/1973 | Ueda | 160/199 |
| 3,750,737 | 8/1973 | Woodward | 160/206 |
| 3,946,790 | 3/1976 | Besse | 160/199 X |
| 4,014,377 | 3/1977 | Kochanowski | 160/186 |
| 4,256,164 | 3/1981 | Agcaoili | 160/196.1 X |
| 4,276,919 | 7/1981 | Walters | 160/199 X |

*Primary Examiner*—David M. Purol

*Attorney, Agent, or Firm*—Lowe, Price, LeBlanc & Becker

[57] ABSTRACT

Apparatus is provided for securely and movably supporting a pair of folding doors hinged to each other at adjacent vertical sides and guidedly supported between upper and lower parallel rail members each of which includes a pair of elongate parallel guide rails. Elements provided on each of the two hinged doors engage the respective upper guide rails and both of the lower guide rails to be supported thereby and to be guided therealong so that the two hinged doors can be easily folded to be almost parallel to each other to permit wide opening of a doorway opening.

16 Claims, 5 Drawing Sheets

DEVICE FOR SUPPORTING FOLDING DOORS

This application is a continuation of application Ser. No. 07/308,619 filed Feb. 10, 1989, now abandoned.

FIELD OF THE INVENTION

The present invention relates to a device for supporting folding doors and, in particular, to a device for supporting suspension type folding doors capable of being moved right and left while kept folded.

BACKGROUND OF THE PRIOR ART

A drawback common to folding doors is that when the suspension bases which are the running members for suspending the folding doors approach each other for folding of the doors the doors are brought into a state similar to suspension from a point and are likely to sway sideward, thereby becoming hard to move.

For preventing such a sideward sway of the folding doors at the time of folding, prior art solutions, e.g., as disclosed in Japanese Utility Model Registration Official Gazette, No. 62-7832, have been proposed. In the device according to this prior art, running members are respectively provided with projections each directed toward and adapted to abut on the other. Guide rolls are provided on both sides of each projection in such a manner that respective tips of both projections abut on each other for keeping the doors folded roughly into the shape of a "V" while preventing the doors from folding so much as to be parallel with each other, to thus prevent sideward sway of the folding doors.

Such a device, however, has the considerable drawback that the doors are folded in the shape of a "V" opening at a large angle and not in parallel with each other and thus may be obstructive when near a space to be used as a passageway. Particularly, when a combination of a plurality of folding doors capable of moving right and left along rails are used for a partition, a width of opening of the opened partition is largely reduced as far as the doors are folded in the "V" shape and, therefore, the partition is not suitable for substantial service unless the folding doors are removed.

SUMMARY OF THE DISCLOSURE

A primary object of the present invention is to provide a folding door supporting device of a simple structure which permits the doors to be folded almost parallel to and as close as possible to each other at their respective wide sides and, in addition, is provided with upper liners capable of effectively preventing sideward sway of the folding doors.

This object is realized by providing an apparatus for securely and movably supporting a pair of folding doors hinged to each other at their respective adjacent vertical sides, comprising an upper rail member, comprising flanges respectively defining elongate horizontal first and second parallel upper door guide rails, a lower rail member comprising flanges respectively defining elongate horizontal first and second parallel lower door guide rails disposed respectively below and parallel to said first and second upper door guide rails, a first door support means for pivotably supporting a first one of said pair of folding doors solely on said first upper door guide rail, attached to said first door at a predetermined distance from the hinged side thereof and engaging with said first and second upper guide rails and said first and second lower guide rails to be movably guided therealong; and a second door support means for pivotably supporting a second one of said pair of folding doors solely on said upper door guide rail, attached to said second door at a predetermined location from the hinged side thereof and engaging with said first and second upper guide rails and said first and second lower guide rails to be supported by and movably guided therealong.

DESCRIPTION OF THE PREFERRED EMBODIMENT

A preferred embodiment of the present invention will now be described in detail with reference to the drawings.

Figure 2:
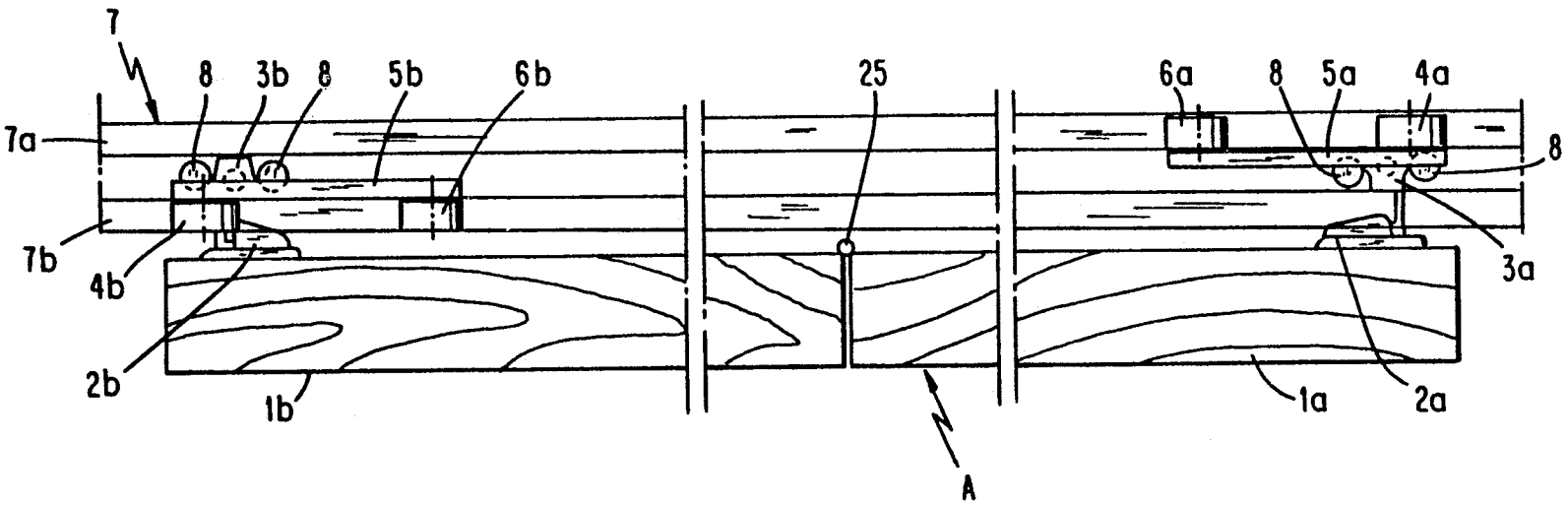
FIG. 2 is a partially sectioned plan view of the closed folding doors, at II—II per FIG. 4.

In FIG. 2, the reference character "A" indicates a folding door composed of a pair of doors 1*a* and 1*b* foldably connected to each other through hinges 25. The doors 1*a* and 1*b* are provided with upper running liner supporting members 3*a* and 3*b*, to which running liners 4*a* and 4*b* are fixed at uppermost ends thereof through draw type sliding hinges 2*a* and 2*b*, respectively. Stays 5*a* and 5*b* extend from the respective running liners supporting members 3*a* and 3*b* generally toward each other. These stays 5*a* and 5*b* are arranged on separate parallel lines to avoid collision therebetween when they approach each other. Additional running liners 6*a* and 6*b*, also running on separate rails, are respectively provided on the tips of the stays 5*a* and 5*b*, respectively. In the embodiment shown in the drawings, the running liners 4*a* and 6*a* are adapted to run on the rail 7*a* of the cross-sectionally channel-like rail member 7, with the other running liners 4*b* and 6*b* running on the parallel adjacent rail 7*b* on the other side.

Figure 1:
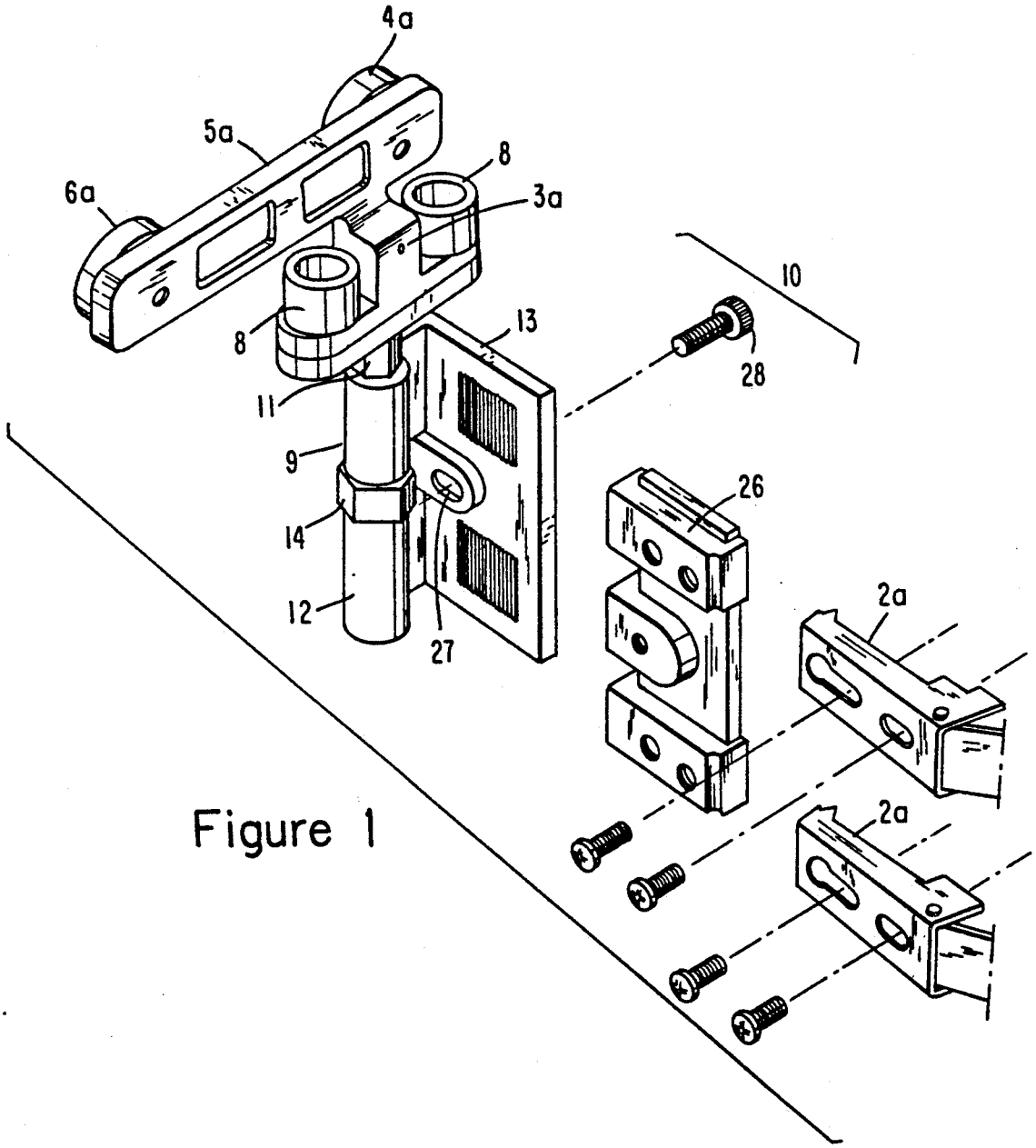
FIG. 1 is a perspective view of a part of an upper running liner according to the present invention.
Figure 4:
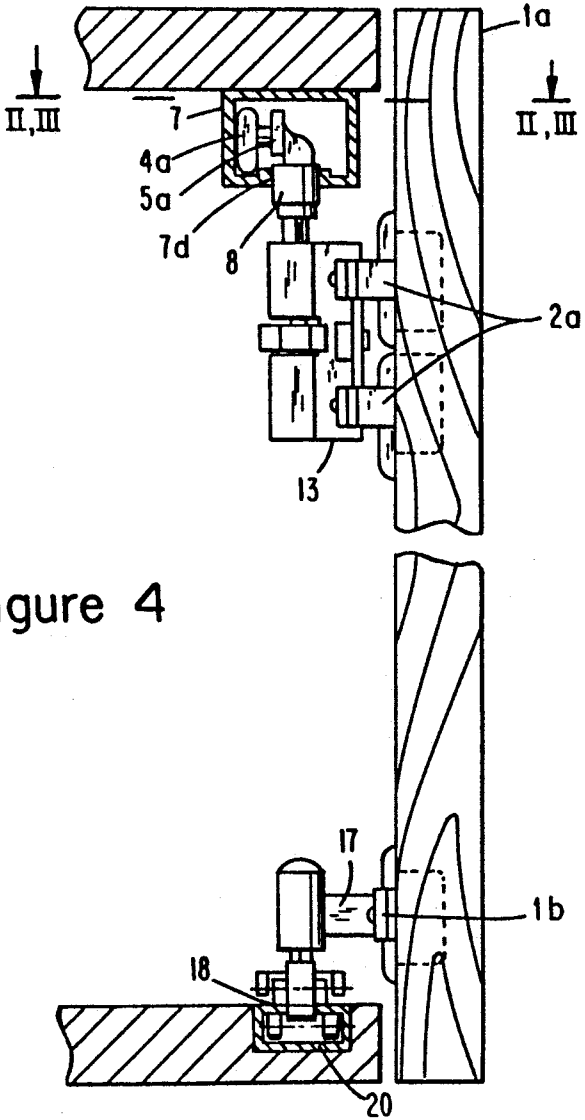
FIG. 4 is a vertical sectional view of one of the doors.
Figure 3:
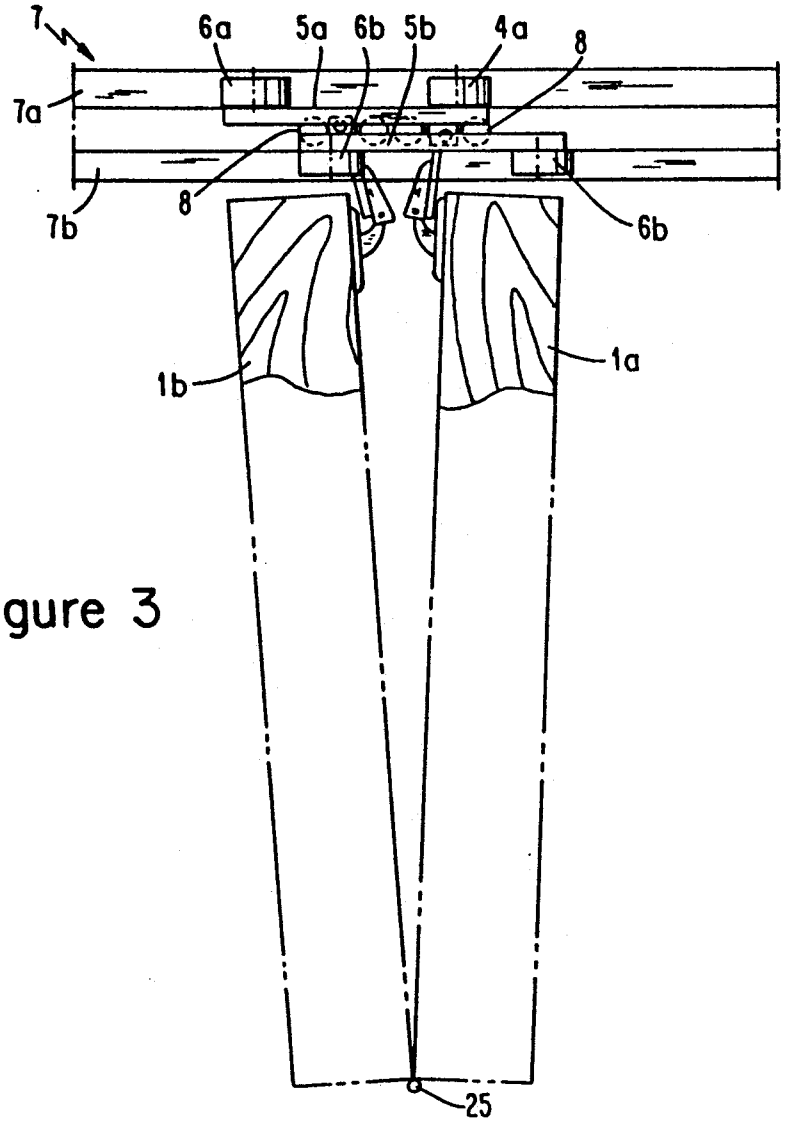
FIG. 3 is a partially sectioned plan view of the folded doors, at III—III per FIG. 4.

The running liner supporting members 3*a* and 3*b* are each provided with stabilizer rollers 8, each rotating around a vertical axis as best seen in FIGS. 1 and 4. These stabilizer rollers 8 are disposed in the opening 7*c* of the channel-like member 7, between the rails 7*a* and 7*b* thereof, and prevent the folding doors from swinging back-and-forth during use of the folding doors.

Running liner supporting members 3*a* and 3*b* are fixed to sliding hinges 2*a* and 2*b* so as to be positionally adjustable with respect to the hinges through vertical distance adjusting means 9 and horizontal distance adjusting means 10. See FIGS. 1 and 4.

Figure 5:
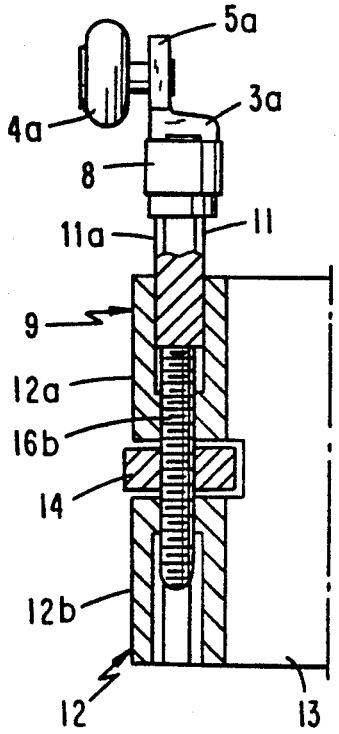
FIG. 5 is a sectional view of vertical distance adjusting means for the upper running liners according to a preferred embodiment.

Vertical distance adjusting means 9, as shown in FIGS. 1 and 5, include an axial member 11 depending from the running liner supporting member 3*a* or 3*b* and a fixing member 13 which is connected to one of sliding hinges 2*a* or 2*b*, and are provided with a fixing member 13 having a cylindrical part 12 to receive the axial member 11. The axial member 11 is fitted into the cylindrical part 12 to be movable with respect thereto only in the vertical direction while being prevented from rotating by a diametrally different upper part 11*a* of the axial member 11, and a threaded part 11*b* is driven into a nut member 14 only rotatably fixed to the middle part the cylindrical part 12. The running liner 4*a* or 4*b*, therefore, can be readily adjusted vertically by turning of the nut member 14.

Figure 6:
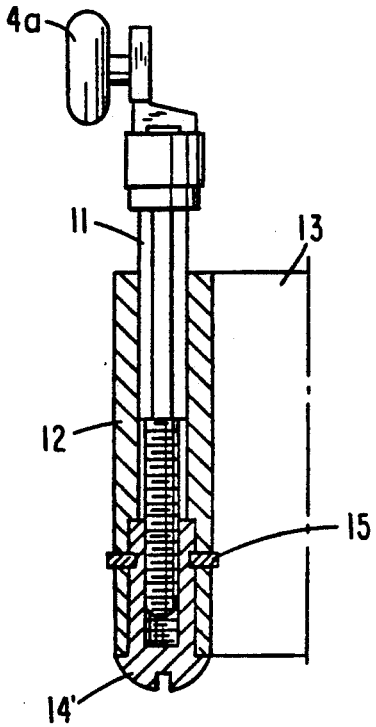
FIG. 6 is a sectional view of another kind of vertical distance adjusting means.

Vertical adjustment from the lower side, similarly, may easily be performed by an arrangement that has, as shown in FIG. 6, a nut member 14' fitted into the fixing member 13, from the lower side of the cylindrical part 12 and retained rotatably and undetachably by a coupling 15.

Horizontal distance adjusting means 10 is formed in such manner that a base plate 26 is secured to one of hinge members 2*a* and 2*b* made to be adjustable in the horizontal direction, and is fixed to the fixing member 13 to be horizontally adjustable by means of an oblong hole 27 and a setting screw 28. See FIG. 1.

A structure is provided per FIG. 5, in which the cylindrical part 12 of the fixing member 13 is divided at the midpoint, and has upper and lower parts 12*a* and 12*b* disposed symmetrically with respect to the middle point. A nut member 14 provided to mesh with the shaft member 10 is fitted into the space between the upper and lower cylindrical parts 12*a* and 12*b*. This structure is usable as a fixing member applicable to either side of the door, because the function thereof is not changed when the structure is inverted and transferred from one side to the other, thereby enabling reduction in the number of different component parts required.

Figure 7:
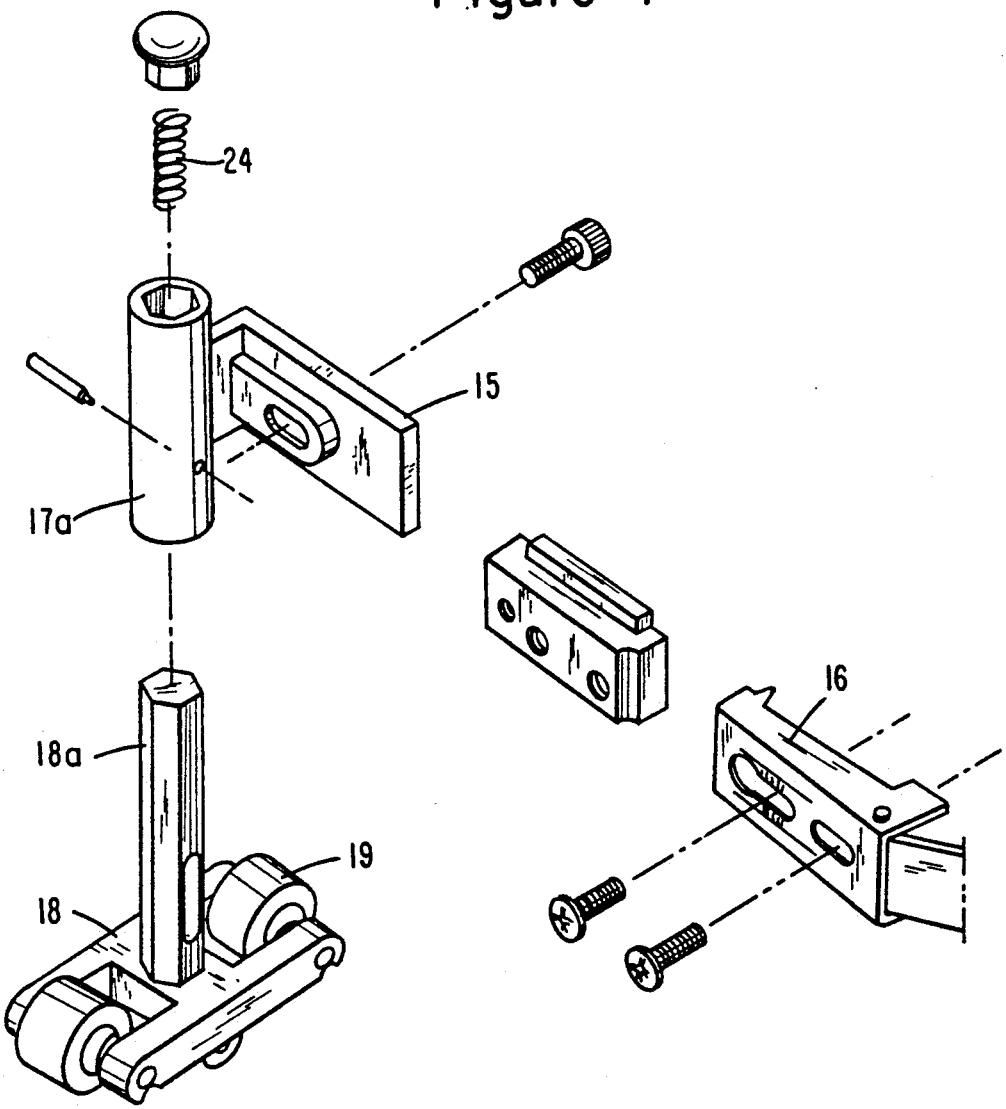
FIG. 7 is a perspective view of a part of the lower running member.

To the lower parts of the doors 1*a* and 1*b*, lower running liners 19 are fixed through sliding hinges 16, fixing members 17, and lower running liner supporting member 18. The running liner supporting member 18 is preferably provided with a vertical shaft 18*a* of non-circular cross-section which is inserted into a cylindrical part 17*a* of the fixing member 17 so as to be vertically displaceable and is further provided at its top end with a cushion spring 24 constantly acting downward to provide an upwardly directed reaction force acting to supporting fixing member 17. This mechanism mitigates vertical vibration at the time of running of the door. See FIG. 7.

Figure 8:
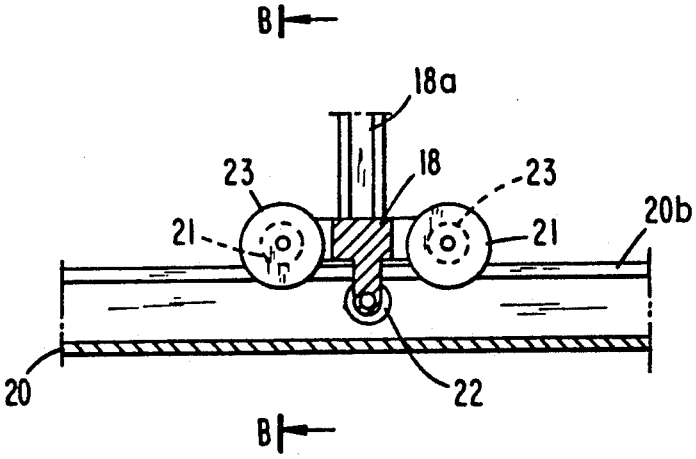
FIG. 8 is a sectional view of a roller part of the lower running member.
Figure 9:
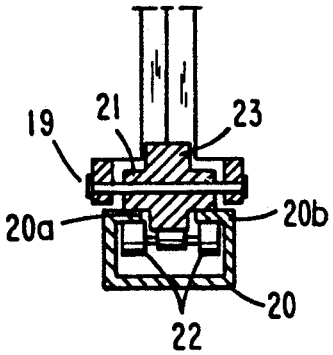
FIG. 9 is a sectional view taken along the line B—B in FIG. 8.

The running liner 19 is shaped, as shown in FIGS. 8 and 9, to run along a channel-like lower rail member 20 having an upper narrow opening between parallel rails 20*a* and 20*b*, and is composed of two upper rollers 21, 21 to run on the uppermost surfaces of the rails 20*a* and 20*b* of the rail member 20 and of a pair of lower rollers 22 disposed to run along the parallel bottom surfaces of the rails 20*a* and 20*b* while racing the upper rollers 21, 21 with horizontal thicknesses of the rails 20*a* and 20*b* between, the upper rollers 21 each being provided with an insert 23 to be fitted into the opening between the rails 20*a* and 20*b* for closing a part of the opening. Such a structure, as described above, prevents the doors 1*a* and 1*b* from floating and swaying sideward.

In the above-described structure, due to the arrangement in which stays 5*a* and 5*b* as well as the additional running liners 6*a* and 6*b* (at the tips of the stays) are disposed on parallel lines, the doors 1*a* and 1*b* are freed from collision therebetween when folded at the hinges. The doors, therefore, can be folded to be almost parallel with and close to each other at their sides, whereby an open distance between the doors can be made large. The doors 1*a* and 1*b* are suspended while folded, by two liners appropriately spaced from each other by the stays, i.e., the upper running liners 2*a* and 2*b* as well as sub-liners 4*a* and 4*b*. Hence they are retained in stable manner without sideward sway, to be capable of smooth opening and closing and also of smooth displacement while in a folded state, thereby serving as an effective partition. Furthermore, because the running liner supporting members are fixed to the door to be positionally adjustable by the vertical distance adjusting means 10 with respect to the hinge members and by the horizontal distance adjusting means 13, the desired balance between the folding doors in the horizontal direction and any gap against the rail can be easily adjusted to ensure exact suspension of the doors.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

I claim:

1. Apparatus for securely and movably supporting a pair of folding doors hinged to each other at their respective adjacent vertical sides, comprising:

an upper rail member, comprising flanges respectively defining elongate horizontal first and second parallel upper door guide rails;

a lower rail member, comprising flanges respectively defining elongate horizontal first and second parallel lower door guide rails disposed respectively below and parallel to said first and second upper door guide rails;

first door support means for pivotably supporting a first one of said pair of folding doors solely on said first upper door guide rail, attached to said first door at a predetermined distance from the hinged side thereof and engaging with said first and second upper guide rails and said first and second lower guide rails to be movably guided therealong; and second door support means for pivotably supporting a second one of said pair of folding doors solely on said second upper door guide rail, attached to said second door at a predetermined location from the hinged side thereof and engaging with said first and second upper guide rails and said first and second lower guide rails to be supported by and movably guided therealong.

2. Apparatus according to claim 1, wherein:

said first and second door support means each comprises respective upper and lower door support assemblies that correspondingly engage said first and second upper and lower door guide rails, whereby said doors are supported to be folded at said hinges therebetween, said upper and lower door assemblies being movable relative to each other along separate but parallel paths defined by said first and second upper and lower door guide rails to enable said folded doors to approach closely to each other while securely supported.

3. Apparatus according to claim 1, further comprising:

means for adjusting a vertical and a horizontal relationship between each of said doors and said first and second door support means correspondingly supporting the same.

4. Apparatus according to claim 2, further comprising:

means for adjusting a vertical and a horizontal relationship between each of said doors and said first and second door support means correspondingly supporting the same.

5. Apparatus according to claim 2, wherein:

said lower door support assemblies each comprise spring means for providing a supporting force to a corresponding door.

6. Apparatus according to claim 3, wherein:

said lower door support assemblies each comprise spring means for providing a supporting force to a corresponding door supported thereby.

7. Apparatus according to claim 4, wherein:

said lower door support assemblies each comprise spring means for providing a supporting force to the corresponding door supported thereby.

8. Apparatus according to claim 1, wherein:

said first and second door support means each includes corresponding running liner supporting members respectively fixed to said corresponding first and second doors through hinge members, a pair of running liners supported by each of said running liner supporting members, stays disposed to extend between the individual running liners of each of said pairs of running liners, said stays being movable along separate parallel paths determined by the dispositions of said first and second upper and lower door guide rails, and subliners provided on the respective tips of said stays, said subliners being shaped and sized to correspondingly run along said first and second upper and lower guide rails.

9. A folding door assembly, comprising:

a pair of folding doors hinged to each other at respective adjacent vertical sides;

first and second parallel upper door guide rails defined by respective flanges of an upper rail member;

first and second parallel lower door guide rails, defined by respective flanges of a lower rail member, respectively below said first and second upper door guide rails;

first door support means for pivotably supporting a first one of said pair of folding doors solely on said first upper door guide rail, attached to said first door at a predetermined distance from the hinged side thereof and engaging with said first and second upper guide rails and said first and second lower guide rails to be movably guided therealong; and second door support means for pivotably supporting a second one of said pair of folding doors solely on said second upper door guide rail, attached to said second door at a predetermined location from the hinged side thereof and engaging said first and second upper guide rail and said first and second lower guide rails to be movably guided therealong.

10. Apparatus according to claim 9, wherein:

said first and second door support means each comprise respective upper and lower door support assemblies that correspondingly engage with said first and second upper and lower door guide rails, whereby said doors are supported to be folded at said hinges therebetween, said upper and lower door assemblies being movable relative to each other along separate but parallel paths defined by said first and second upper and lower door guide rails to enable said folded doors to approach closely to each other while being securely supported.

11. Apparatus according to claim 9, further comprising:

means for adjusting a vertical and a horizontal relationship between each of said doors and said first and second door support means correspondingly supporting the same.

12. Apparatus according to claim 10, further comprising:

means for adjusting a vertical and a horizontal relationship between each of said doors and said first and second door support means correspondingly supporting the same.

13. Apparatus according to claim 9, wherein:

said lower door support assemblies each comprise spring means for providing a supporting force to a corresponding door.

14. Apparatus according to claim 11, wherein:

said lower door support assemblies each comprise spring means for providing a supporting force to a corresponding door.

15. Apparatus according to claim 12, wherein:

said lower door support assemblies each comprise spring means for providing a supporting force to a corresponding door supported thereby.

16. Apparatus according to claim 9, wherein:

said first and second door support means each includes corresponding running liner supporting members respectively mounted to said corresponding first and second doors through hinge members, a pair of running liners supported by each of said running liner supporting members, stays disposed to extend between the individual running liners of each of said pairs of running liners, said stays being movable along separate parallel paths determined by the dispositions of said first and second upper and lower door guide rails, and subliners provided on respective tips of said stays, said subliners being shaped and sized to correspondingly run along said first and second upper and lower guide rails.

* * * * *